United States Patent [19]

Gosset et al.

[11] 4,302,364

[45] Nov. 24, 1981

[54] LIQUID DETERGENT COMPOSITIONS COMPRISING ANIONIC, NONIONIC AND CATIONIC SURFACTANTS

[75] Inventors: Pierrette Gosset, Strombeek-Bever; Rainer Lodewick, Meise, both of Belgium

[73] Assignee: The Procter & Gamble Company, Cincinnati, Ohio

[21] Appl. No.: 64,262

[22] Filed: Aug. 6, 1979

[30] Foreign Application Priority Data

Aug. 10, 1978 [GB] United Kingdom ..... 32939/78

[51] Int. Cl.[3] ..... C11D 1/86; C11D 3/42

[52] U.S. Cl. ..... 252/545; 252/153; 252/174.12; 252/546; 252/547; 252/548; 252/559

[58] Field of Search ..... 252/8.75, 545, 547, 252/559, DIG. 14, 546, 548, 153

[56] References Cited

U.S. PATENT DOCUMENTS

| | | | |
|---|---|---|---|
| 3,985,686 | 10/1976 | Barrat | 252/547 |
| 4,058,489 | 11/1977 | Hellsten | 252/547 |
| 4,075,118 | 2/1978 | Gault et al. | 252/135 |
| 4,110,262 | 8/1978 | Arnau et al. | 252/545 |
| 4,111,855 | 9/1978 | Barrat et al. | 252/545 |
| 4,147,649 | 4/1979 | Arnau et al. | 252/174.22 |
| 4,199,464 | 4/1980 | Gambre | 252/91 |
| 4,199,465 | 4/1980 | Rodriguez | 252/91 |

FOREIGN PATENT DOCUMENTS

| | | | |
|---|---|---|---|
| 818419 | 7/1969 | Canada . | |
| 2433079 | 6/1975 | Fed. Rep. of Germany . | |
| 52-36109 | 3/1977 | Japan | 252/547 |
| 641297 | 8/1950 | United Kingdom . | |
| 830864 | 3/1960 | United Kingdom . | |
| 873214 | 7/1961 | United Kingdom . | |

*Primary Examiner*—P. E. Willis, Jr.

[57] ABSTRACT

Liquid builder-free concentrated heavy-duty detergent compositions containing a ternary surfactant system, the majority of which is represented by an anionic surfactant, are disclosed. These compositions provide superior overall performance, especially greasy and oily stain removal and storage stability.

1 Claim, No Drawings

LIQUID DETERGENT COMPOSITIONS COMPRISING ANIONIC, NONIONIC AND CATIONIC SURFACTANTS

BACKGROUND OF THE INVENTION

The present invention relates to highly effective liquid, concentrated, homogeneous, builder-free heavy-duty detergent compositions. These compositions comprise an anionic synthetic surfactant, an ethoxylated nonionic surfactant, a cationic surfactant and a liquid carrier. The majority of the ternary active mixture is comprised of the anionic synthetic surfactant. In the description of the invention, the terms "ternary active system" and "ternary active mixture" are used interchangeably. An effective suds regulant system suitable for effective suds control under laundry conditions favorable to suds-formation, for example in automatic washing machine laundering at temperatures in the range from 60° C–90° C., is also described. This suds regulant system unexpectedly provides "prolonged" suds-regulation as for example can be needed to avoid rinsing suds-problems due to surfactant carry over. The suds regulant is comprised of a silicone suds suppressant and a saturated fatty acid.

The effectiveness of liquid detergent compositions depends upon a large series of factors such as the intended usage conditions inclusive of concentration, type of laundering operations, surfactant concentration, type of machine or topical application. In addition, it is required that these compositions remain stable and homogeneous under a broad range of storage conditions and during manipulation in the distribution system.

Liquid, heavy-duty detergent compositions containing a synthetic organic detergent compound, which is generally anionic, nonionic or mixed anionic-nonionic in nature; an inorganic builder salt; and a solvent, are disclosed, for example, in U.S. Pat. Nos. 2,551,634; 2,908,651; 2,920,045; 2,947,702; 3,239,468; 3,272,753; 3,393,154; 3,554,916; 3,697,451; 3,709,838; Belgian Pat. Nos. 613,165, 665,532; 794,713 and 817,267; British Pat. Nos. 759,877; 842,813; and German Application Nos. 16 17 119; 19 37 682; 23 27 861; 23 30 840; 23 61 448; and 23 62 114. These compositions frequently contain a hydrotrope or solubilizing agent to permit the addition of sufficient quantities of surfactants and usual builder salts to provide a reasonable volume usage/performance ratio. Substantially anhydrous liquid compositions containing an alkanolamine component are known from U.S. Pat. No. 3,528,925. Soap containing liquid compositions are disclosed in U.S. Pat. No. 2,875,153 and 2,543,744. It has also been suggested (French Pat. Nos. 2,343,804 and 2,343,805) that effective concentrated liquid detergent compositions can be prepared containing high levels of nonionic ethoxylated surfactants.

Notwithstanding the investment of substantial research efforts aimed at developing built and builder-free liquid detergent compositions, there are several problems associated with the art-disclosed compositions which render them less optimal for wide scale use, undesirable from an ecological standpoint in improperly treated sewage, objectionable from a performance point of view in cleaning both natural and synthetic fibers and subject to instability under sever storage conditions. Consequently, there is a standing desire to generally improve these liquid detergents especially builder-free concentrated liquid detergents with a view to adapt them, as per se substitutes for granular detergents, for wide-scale use over a broad range of laundering conditions.

While known highly concentrated liquid detergent compositions require the utilization of high levels of nonionic surfactants, especially nonionic ethoxylates, with a view to achieve consumer acceptable performance particularly greasy and oily stain removal, such formulae could deserve improvement with respect to other important performance and utilization factors inclusive of bleach-sensitive and proteinaceous stain removal. It is also known that high levels of nonionic ethoxylates can give rise to processing difficulties, especially relative to the avoidance of phase separation, high chill points and the homogeneous incorporation of minor ingredients. Well-known usage difficulties inherent to high levels of nonionics relate to effective suds-control and rinsing in any washing step. In fact, the difficulties inherent to commercially viable concentrated builder-free liquid detergents require a balancing of a series of factors inclusive of: ease-of-processing, suds levels adapted to washing machines, superior performance for a broad range of stains under varying usage conditions, and stability over prolonged periods of storage.

It has been found that superior detergency, in particular with respect to greasy-oily stains, suds-control, ease-of-processing and storage stability is obtained from concentrated heavy-duty liquid detergent compositions containing a ternary anionic/nonionic/cationic surfactant system the majority of which is represented by the anionic detergent, and a liquid carrier.

It has also been found that a specific suds regulant system containing a silicone suds suppressant, and a saturated fatty acid are especially effective for suds control under severe conditions inclusive of the avoidance of suds problems in the rinse as a result of surfactant carry over.

It is a main object of the invention to provide liquid concentrated builder-free heavy-duty detergent compositions which can be used in lieu of granular built detergent compositions over a wide range of laundering conditions.

It is another object of this invention to formulate highly effective concentrated builder-free liquid detergent compositions which can easily be made and, remain homogeneous and, in general do not loose their effectiveness over prolonged periods of storage.

These objects have now been resolved as can be seen from the following description of the invention.

SUMMARY OF THE INVENTION

The present invention is based on the discovery that highly effective storage stable builder-free concentrated liquid detergent compositions can be formulated containing:

(a) from about 35% to about 65%, preferably from about 40% to about 55% by weight of a ternary surfactant mixture containing by reference to the sum of the ingredients in said ternary mixture:

(i) from 50% to about 70% by weight of an anionic synthetic surfactant;

(ii) from 15% to 74% by weight of an ethoxylated nonionic surfactant; and (iii) from 3% to 15% by weight of a cationic surface-active agent; and (b) a solvent system comprising water and from about 2 to 20% of a compatible organic solvent.

In one aspect of this invention, the nonionic surface-active agent is most preferably represented by the condensation product of a linear fatty alcohol having from 12 to 16 carbon atoms in the alkyl chain and from about 5 to 8 moles of ethylene oxide per mole of fatty alcohol.

The preferred cationic surface-active agents are represented by water-soluble quaternary ammonium compounds containing one long alkyl chain containing most preferably from 10 to 16 carbon atoms.

In a particularly preferred aspect of this invention, the liquid builder-free compositions herein comprise from about 0.1% to about 1.5% by weight of a polyacid, especially alkylene-polyamino-polyalkylene phosphonic acids, and have a substantially neutral pH in the range from about 6 to 7.5.

DETAILED DESCRIPTION OF THE INVENTION

This invention relates to builder-free highly concentrated liquid detergent compositions which are characterized by superior laundry cleaning performance, ease-of-preparation, ease-of-use and storage stability. The inventive parameters are explained and exemplified in more detail hereinafter.

Unless indicated to the contrary, the "percent" indications stand for "% by weight".

The highly concentrated builder-free compositions herein comprise from about 35% to about 65%, preferably from about 40% to about 55%, of a ternary surfactant mixture. The ternary system is comprised of an anionic, an ethoxylated nonionic and a cationic surface-active agent. The anionic surfactant represents, expressed by reference to the sum of the ingredients in the ternary surfactant mixture, from 50% to about 70%; the ethoxylated nonionic from about 15% to about 47%, preferably from about 25 to 47% of the ternary surfactant mixture; and the cationic surface-active agent represents from about 3% to 15%, preferably from 3% to 9% of the ternary surfactant mixture.

The anionic surface-active agent is represented by all synthetic anionic detergents which are known to be suitable for use in detergent compositions. Preferred herein are anionic synthetic water-soluble salts of organic sulfuric reaction products having in their molecular structure an alkyl radical containing from about 8 to about 22 carbon atoms and a radical selected from the group consisting of sulfonic acid and sulfuric acid ester radicals. Examples of preferred alkali metal salts are the reaction products obtained by sulfating $C_8$–$C_{18}$ fatty alcohols derived from tallow and coconut oil. Other preferred surfactants include water-soluble alkyl benzene sulfonates wherein the alkyl group contains from about 8 to about 15 carbon atoms; sodium alkyl glyceryl ether sulfonates, especially ethers of fatty alcohols derived from tallow and coconut oil; sodium coconut fatty acid monoglyceride sulfates and sulfonates; water-soluble salts of the sulfation product of the condensation products of one mole of a higher fatty alcohol, such as tallow or coconut fatty alcohols, and from about 1 to 6 moles of ethylene oxide; and water-soluble salts of paraffin sulfonates having from about 8 to about 22 carbon atoms in the alkyl chain. Other preferred anionic detergents include sulfonated olefins as more fully described in e.g. U.S. Pat. no. 3,332,880, incorporated herein by reference.

A particularly preferred anionic surfactant component herein is represented by water-soluble salts of an alkyl benzene sulfonic acid, preferably an alkanolamine alkyl benzene sulfonate having from about 8 to about 15 carbon atoms in the alkyl group. The alkanolamine cation can include species selected from mono-, di- or tri-ethanolamine salts; preferred are tri-ethanolamine salts.

The anionic surfactant component must be used in an amount from 50% to 70% by weight of the ternary surfactant system. Using levels substantially below 50% will impair noticeably the cumulative performance parameters especially in respect to the removal of bleach sensitive stains and whiteness maintenance. Using levels substantially above 70% by weight of the ternary active system will diminish processability and storage stability particularly in presence of preferred minor additives.

Another essential component in the ternary surfactant is represented by an ethoxylated nonionic surfactant in an amount from about 15% to about 47%, preferably from about 25% to 47% of the ternary active system. Increasing the relative amount of the nonionic ethoxylate above the upper limit can adversely affect overall performance, particularly bleach sensitive stain removal and ease-of-dispersibility. The nonionic synthetic detergent component contains a hydrophobic organic radical condensed with an ethyleneoxide hydrophilic moiety. All ethoxylated nonionic surfactants which are known to be suitable for use in detergent application can be used in the compositions of this invention. Preferred nonionic species herein are polyethoxylates derived from primary and secondary aliphatic alcohols having from 8 to 24 carbon atoms in the alcohol alkyl chain. These preferred ethoxylates frequently contain from 3 to about 14 moles of ethylene oxide per mole of hydrophobic moiety.

The nonionic ethoxylated component can also be represented by a mixture of 2 separately ethoxylated nonionic surfactants having a different degree of ethoxylation. For example, the nonionic ethoxylate can be represented by mixtures of a first ethoxylated surfactant containing from 3 to 8 moles of ethylene oxide per mole of hydrophobic moiety and a second ethoxylated species having from 8 to 14 moles of ethylene oxide per mole of hydrophobic species. A preferred weight ratio of lower (3-8EO) ethoxylate to higher (8-14 EO) ethoxylate is from about 2:1 to 1:5.

Preferred nonionic surfactant species can be represented by a mixture of:(1) an alcohol ethoxylate obtained from a primary alcohol with less than 30% branched-chain structure, and having from 14 to 22, especially from 16 to 19 carbon atoms in the hydrocarbyl chain, and 8 to 14 moles of ethylene oxide; and (2) an alcohol ethoxylate obtained from a primary alcohol with less than 30% branched-chain structure and having from 9 to 15, especially from 12 to 15 carbon atoms in the hydrocarbyl chain, and 3 to 7 moles of ethylene oxide. Other preferred nonionic ethoxylates herein are represented by the condensation product of from 3 to 9 moles of ethylene oxide with 1 mole of a primary alcohol of about 25% branched-chain structure and having 14 to 15 carbon atoms in average. Another preferred nonionic ethoxylate herein is represented by the condensation product of a linear fatty alcohol having from 12 to 16 carbon atoms in the alkyl chain, and from about 5 to 8 moles of ethylene oxide per mole of fatty alcohol.

The third essential ingredient in the active system is represented by a cationic surface-active agent. All cationic surface-active agents which are known to be suitable for use in detergent application can be used in the compositions of this invention. Well-known classes of suitable cationic surface-active agents include: mono-fatty alkyltri-$C_1$–$C_6$ alkyl ammonium salts; di-fatty alkyl di-$C_1$–$C_6$ alkyl ammonium salts; fatty alkyl imidazolinium salts; fatty alkyl pyridinium salts; and mixtures thereof.

The cationic surface-active agent is present in an amount from about 3% to 15%, preferably from 3% to 9% by reference to the sum of the ingredients in the ternary active system. The utilization of more than 15% of cationic ingredient will lead to stability problems inclusive of phase-separation, marginal compatibility with additional components which are frequently incorporated in the detergent composition herein, and processing problems especially related to marginal stability of the total composition. Using less than 3% of the ternary active system of the cationic ingredient will result in substandard performance, especially with respect to the removal of greasy and oily stains.

The cationic surface-active agent is preferably represented by a quaternary ammonium compound of formula $$(R_1R_2R_3R_4N)^+X^-$$

wherein $R_1$ is an alkylgroup having from 6 to 22, more preferably from 10 to 16 carbon atoms, $R_2$ and $R_3$ independently represent alkyl or alkylhydroxyradicals having from 1 to 6 carbon atoms in the alkylchain and $R_4$ is selected from $R_2$, $R_3$ and alkylbenzene radicals having from 1 to 10 carbon atoms in the alkylchain; and X is a suitable anionic radical, preferably selected from the group of: hydroxide, halide, sulfate, methyl(or metho)-sulfate, ethylsulfate and phosphate ions.

The quaternary ammonium compounds useful include both water-soluble and water-insoluble (water-dispersible) materials. Preferred are water-soluble species having a solubility in water of greater than 0.5% at 20° C.

Representative examples of suitable quaternary ammonium compounds herein include: octyldihydroxyethylmethylammonium halides; dodecyldihydroxyethylmethylammonium bromide; coconut ($C_{12}$–$C_{14}$)hydroxyethyldimethylammonium methosulfate; alkyl($C_{14}$–$C_{16}$-)dihydroxyethylmethylammonium sulfate; myristyl di[$(CH_2CH_2O)_3H$]-methylammonium bromide, decylbutyldihydroxyethylammonium methosulfate, and coconut($C_{12}$–$C_{14}$)dihydroxyethylmethylammonium chloride.

Polyethoxylated alkylbenzyl quaternary ammonium compounds can also be used as cationic surface-active agent. This class of cationics can be exemplified by the following formula:

$C_8$–$C_{18}$ alkyl di-[$(C_2H_4O)_nH$) benzylammonium salts, wherein n is an integer from 1 to 14, preferably 1 to 8. Preferred examples of the benzylammonium salts for use herein are: coconut($C_{12}$–$C_{14}$)dihydroxyethylbenzylammonium chloride; and myristyl di-[$(C_2H_4O)_7H$-]benzylammonium methosulfate.

If desired, the ternary active system can contain minor amounts i.e. less than 20% by reference to the total active system, of other surface-active agents such as semi-polar, ampholytic and/or zwitterionic surfactants.

The liquid medium of the compositions herein is represented by a solvent system comprising water and from about 2% to 20% of a compatible organic solvent which is preferably selected from the group consisting of lower aliphatic alcohols having from 1 to 6 carbon atoms and from 1 to 3 hydroxyl groups; ethers of diethyleneglycol and lower aliphatic monoalcohols having from 1 to 4 carbon atoms and mixtures thereof. Suitable species of compatible organic solvents include: ethanol, n-propanol, isopropanol, butanol, 1,2-propanediol, 1,3-propanediol and n-hexanol. Examples of preferred glycol ether compounds include: monomethyl-, -ethyl-, -propyl- and monobutylethers of diethylene glycol; and mixtures thereof. Other organic solvents having a relatively high boiling point and low vapor pressure can also be used, provided they do not react with the other ingredients of the composition.

The compositions herein frequently contain a series of minor detergent additives in the art-established levels for their known utility. Such additives can be represented by suds regulating agents, enzymes, anti-tarnishing agents, corrosion inhibitors, dyes, perfumes, and the like. A particularly preferred additive is represented by a polyacid or mixture of polyacids in an amount from about 0.1% to about 1.5%. Preferred polyacids are those having one pK value of at least 5.5. The pK is measured at a temperature of the water in the range from about 10° C. to 30° C. The most preferred polyacids are represented by alkylene-polyaminopolyalkylene phosphonic acids such as:ethylene diaminetetramethylene phosphonic acid; hexamethylenediaminetetramethylene phosphonic acid; diethylenetriamine pentamethylene phosphonic acid; and amino trimethylene phosphonic acid. These phosphonates can also be used in conjunction with a low level of citric acid, for example in a weight ratio of phosphonic acid:citric acid of about 1:1 whereby the sum of the phosphonic and the citric acids is preferably within the polyacid limit defined above.

The compositions in accordance with this invention containing low level of polyacids, especially polyphosphonates, as more fully described above shall preferably have a pH in the range from 6 to 7.5. The pH is expressed "as is" i.e. is measured at ambient temperature on the liquid builder-free concentrated (undiluted) detergent composition. The preferred polyacid containing compositions having a pH below 6 can present stability problems over periods of prolonged storage and also are difficult to process. The compositions havig a pH above 7.5 tend to become less effective in respect to (additive/optimized) bleach-sensitive stain removal resulting from the incorporation of the optional polyacid component.

The effective utilization of the compositions herein under various usage conditions can be beneficially enhanced through the utilization of an effective suds regulant. The very high levels of anionic synthetic detergents herein renders the problem of effective suds control critical. It was found that a mixture of a silicone suds regulant, and a substantially saturated fatty acid having from 14 to 24 carbon atoms is particularly suitable for that purpose especially if this system is used in conjunction with nonionic ethoxylates having a ratio of carbon atoms in the alkyl chain to moles of ethylene oxide per mole of alcohol in the range of 2:1 to 4:3, whereby the number of C-atoms in the alcohol alkyl chain is in the range from 14 to 22. The silicone suds control agent is frequently used in a level not exceeding 0.5%, most preferably between 0.01% and 0.1%. The level of long chain saturated fatty acid shall normally not exceed 2.5% and preferably be restricted to a level of 0.1–1.5%. Suitable examples of silicone are alkylated polysiloxanes such as dimethylpolysiloxanes. The preferred weight ratio of the fatty acid to the silicone is about 25/1.

The compositions herein can also comprise minor amounts of brighteners, fluoresces, anti-microbial agents, enzymes, perfumes, dyes and opacifiers. Such components preferably comprise not more than about 3% of the total composition. Suitable opacifiers can be utilized inasmuch as they contribute to create a uniform esthetical appearance of the concentrated liquid compositions herein. Examples of suitable opacifiers include polystyrenes commercially known as LYTRON 621 and LYTRON 607 manufactured by Monsanto Chemical Corporation. Enzymes can be advantageously added because of their contribution to the removal of specific strains. Suitable enzymes can be represented by proteases, amylases, lipases or mixtures thereof. Proteases are preferred in the compositions herein. They are frequently employed in a level from about 0.01% to about 0.6%.

It is noteworthy that the detergent superiority flowing from the use of the compositions of this invention vs. known liquid detergent compositions is achieved over a broad range of laundry conditions inclusive of under-usage, by reference to conventional product usage, and also over a broad range of laundry temperatures, particularly at laundry temperatures in the range from 35° C. to 60° C.

The following examples illustrate the invention and facilitate its understanding.

EXAMPLE I

Storage stable, homogeneous, non gelling heavy-duty liquid detergents I, B and C were prepared by mixing the individual ingredients in the stated proportions.

| INGREDIENT | Composition in % by weight I | B | C |
|---|---|---|---|
| Triethanolamine salt of a linear alkylbenzene sulfonic acid wherein the alkyl chain length averages 11.7 carbon atoms in length | 24 | 20 | 20 |
| Condensation product of 7 moles of ethylene oxide with 1 mole of a primary alcohol of about 25% branched chain structure having 14 to 15 carbon atoms in average | 18.5 | — | 28.5 |
| Condensation product of branched (72%) fatty alcohol having from 16 to 19 carbon atoms in the alkyl chain, and 11 moles of ethylene oxide per mole of fatty alcohol | — | 20 | — |
| Condensation product of branched (60%) fatty alcohol having from 12 to 15 carbon atoms in the alkyl chain and 4 moles of ethylene oxide per mole of fatty alcohol | — | 10 | — |
| Coconut ($C_{12}$—$C_{14}$) dihydroxyethylmethyl ammonium chloride | 3.5 | — | 1.5 |
| Stilbene brightener | 0.23 | 0.23 | 0.23 |
| Ethanol | 10 | 10 | 10 |
| Triethanolamine (free) - to adjust pH to 7— | 1.5 | 1.5 | 1.5 |
| A 9:1 mixture of dimethylpolysiloxane and aerogel silica emulsified with the aid of ethoxylated stearic acid (Dow Corning DB 110A) containing about 10% active material (polysiloxante/silica) in water | 0.3 | 0.2 | 0.3 |
| Hydrogenated fatty acid having in average 18 to 22 carbon atoms (HYFAC) | 0.75 | 0.5 | 0.75 |

-continued

| INGREDIENT | Composition in % by weight I | B | C |
|---|---|---|---|
| Proteolytic enzyme (Maxatase, commercial enzyme preparation containing 15% pure enzyme) | 0.4 | 0.4 | 0.4 |
| Diethylenetriaminepentamethylenephosphonic acid | 0.3 | 0.3 | 0.3 |
| Citric acid | 0.2 | 0.2 | 0.2 |
| Perfume, dyes | 0.8 | 0.8 | 0.8 |
| Water | Balance to 100 | | |

These compositions were used for washing four loads of about 3 kg each of domestic soiled laundry in a horizontal drum-type automatic washing machine (MIELE 422). Each load contained in addition two cotton and two polyester swatches (20×20 cm), soiled with greasy stains, shoe-polish, make-up and dirty motor oil respectively. The main wash was carried out in about 20 liters of water (hardness: 2.95 millimoles $Ca^{2+}$/liter), at a 0.66% liquid detergent concentration. The washing temperature was raised to about 60° C. over a period of about 20 minutes and maintained at that temperature for a period of about 15 minutes. For comparison purposes, the test swatches were visually graded thereby using a 0–5 scale (0:no stain removal; 5:complete stain removal); the results of all stains and all swatches were pooled.

The testing results were as follows.

| | I vs. B | I vs. C |
|---|---|---|
| on cotton | | |
| Make-up | +1.27* | +0.97* |
| Shoe-polish | +0.43 | +0.10 |
| Dirty motor oil | +0.97* | +0.95* |
| on polyester cotton | | |
| Make-up | +1.15* | +0.89* |
| Shoe-polish | +0.30 | +0.19 |
| Dirty motor oil | +1.70* | +2.15* |

*Significant difference.

The above data show the clear performance benefits derived from composition I in accordance with this invention vs. closely related prior art compositions B and C.

Comparable superior detergent performance, ease-of-use and storage stability is secured from the detergent of Example I wherein the coconut ($C_{12}$–$C_{14}$)dihydroxyethylmethylammonium chloride is replaced by an equivalent amount of: octyldihydroxyethylmethylammonium chloride; dodecyldihydroxyethylmethylammonium bromide; coconut($C_{12}$–$C_{14}$)hydroxyethyldimethylammonium methosulfate; alkyl($C_{14}$–$C_{16}$)dihydroxyethylmethylammonium sulfate; myristyl-di-[$(C_2H_4O)_3H$]-methylammonium bromide; decyl-butyldihydroxyethylammonium methosulfate; coconut($C_{12}$–$C_{14}$)dihydroxyethyl-benzylammonium chloride; and myristyl-di-[$(C_2H_4O)_7H$]benzylammonium methosulfate.

EXAMPLES II–V

Liquid detergents were prepared by mixing the ingredients listed below.

| INGREDIENT | Composition in % by weight II | III | IV | V |
|---|---|---|---|---|
| Triethanolamine salt of a linear alkylbenzene sulfonic acid wherein the alkyl chain length averages 11.7 carbon atoms in length | 24 | 27 | 24 | 26 |
| The condensation product of 7 moles of ethylene oxide with 1 mole of a primary alcohol of about 25% branched chain structure having 14 to 15 carbon atoms in average | 22 | 15 | 18.5 | 10 |
| The condensation product of 4 moles of ethylene oxide with 1 mole of a primary alcohol of about 25% branched chain structure having 14 to 15 carbon atoms in average | — | — | — | 7 |
| Coconut ($C_{12}$—$C_{14}$) dihydroxyethylmethylammonium chloride | 1.5 | 3.5 | — | 3.0 |
| Coconut ($C_8$—$C_{18}$) dihydroxyethylbenzylammonium chloride | — | — | 3.5 | — |
| Stilbene brightener | 0.23 | 0.23 | 0.23 | 0.23 |
| Ethanol | 10 | 10 | 10 | 10 |
| Triethanolamine (free) - to adjust pH to 7 | 1.5 | 1.5 | 1.5 | 1.5 |
| A 9:1 mixture of dimethylpolysiloxane and aerogel silica emulsified with the aid of ethoxylated stearic acid (Dow Corning DB 110A) containing about 10% active material (polysiloxane/silica) in water | 0.4 | 0.3 | 0.3 | 0.3 |
| Hydrogenated fatty acid having in average 18 to 22 carbon atoms (HYFAC) | 1.0 | 0.75 | 0.75 | 0.75 |
| Proteolytic enzyme (Maxatase, commercial enzyme preparation containing 15% pure enzyme) | 0.4 | 0.4 | 0.4 | 0.4 |
| Diethylenetriaminepentamethylenephosphonic acid | 0.3 | 0.3 | 0.3 | 0.3 |
| Citric acid | 0.2 | 0.2 | 0.2 | 0.2 |
| Perfume, dyes | 0.8 | 0.8 | 0.8 | 0.8 |
| Water | | Balance to 100 | | |

Comparative testing was performed as described in Example I above. The test swatches were stained with greasy/oily stains.

The results express the difference in stain removal between prior art composition B and the compositions II, III, IV and V in accordance with this invention.

TABLE

The stain removal results (vs. composition B) were as follows:

| | COMPOSITION II | III | IV | V |
|---|---|---|---|---|
| On cotton | | | | |
| Make-up | +0.80 | +1.36 | +1.07 | +0.75 |
| Lipstick | +1.45* | −0.09 | +0.21 | −0.90* |
| Shoe polish | +1.10* | +0.94 | +0.12 | +0.30 |
| DMO | +0.30 | +1.94* | +1.69* | +1.40* |
| On polyester cotton | | | | |
| Make-up | +0.80 | +0.99 | +1.57* | +1.45* |
| Lipstick | +1.40* | −0.62* | +0.15 | −0.15 |
| Shoe polish | +0.80* | +0.18 | −0.06 | +0.15 |
| DMO | +0.15 | +2.37* | +2.43* | +1.35* |

*significant difference

The above data clearly demonstrate the stain removal superiority of compositions II, III, IV and V in accordance with this invention vs. prior art composition B.

EXAMPLE VI

A liquid detergent was prepared having the composition indicated below. The following ingredients were used.

| INGREDIENT | Composition in % by weight VI |
|---|---|
| Triethanolamine salt of a linear alkylbenzene sulfonic acid wherein the alkyl chain length averages 11.7 carbon atoms in length | 24 |
| The condensation product of 7 moles of ethylene oxide with 1 mole of a primary alcohol of about 25% branched chain structure having 14 to 15 carbon atoms in average | 15 |
| Coconut ($C_{12}$–$C_{18}$) dihydroxyethylmethyl ammonium chloride | 4.0 |
| Stilbene brightener | 0.23 |
| Ethanol | 10 |
| Triethanolamine (free) - to adjust pH to 7 | 1.5 |
| A 9:1 mixture of dimethylpolysiloxane and aerogel silica emulsified with the aid of ethoxylated stearic acid (Dow Corning DB 110A) containing about 10% active material (polysiloxane/silica) in water | 0.3 |
| Hydrogenated fatty acid having in average 18 to 22 carbon atoms (HYFAC) | 0.75 |
| Proteolytic enzyme (Maxatase, commercial enzyme preparation containing 15% pure enzyme) | 0.4 |
| Diethylenetriaminepentamethylenephosphonic acid | 0.3 |
| Citric acid | 0.2 |
| Perfume, dyes | 0.8 |
| Water | Balance to 100 |

Compositions VI was compared by reference to prior art composition B thereby using the evaluation procedure set forth in Example I. The test swatches had been stained with greasy/oily stains.

The stain removal results were as follows:

| | VI vs. B |
|---|---|
| On cotton | |
| Make-up | +0.95* |
| Lipstick | −0.14 |
| Shoe polish | +0.29 |
| DMO | +1.00* |
| On polyester cotton | |
| Make-up | +0.48* |
| Lipstick | −0.32 |
| Shoe polish | +0.44* |
| DMO | +1.50* |

*significant difference.

The testing results show that composition VI of this invention is superior to prior art composition B notwithstanding that the nonionic level has been reduced from 30 to 15%.

EXAMPLE VII

Liquid detergents were prepared having the compositions indicated below. The following ingredients were used.

| INGREDIENT | Composition in % by weight D | E | VII |
|---|---|---|---|
| Triethanolamine salt of a linear alkylbenzene sulfonic acid wherein the alkyl chain length averages 11.7 carbon atoms in length | 21 | 24 | 27 |
| The condensation product of 7 moles of ethylene oxide with 1 mole of a primary alcohol of about 25% branched chain structure having 14 to 15 carbon atoms in average | 27 | 24 | 21 |
| Coconut ($C_{12}$—$C_{18}$) dihydroxyethylmethyl ammonium chloride | 4 | 4 | 4 |
| Stilbene brightener | 0.23 | 0.23 | 0.23 |
| Ethanol | 10 | 10 | 10 |
| Triethanolamine (free) - to adjust pH to 7 | 1.5 | 1.5 | 1.5 |
| A 9:1 mixture of dimethylpolysiloxane and aerogel silica emulsified with the aid of ethoxylated stearic acid (Dow Corning DB 110A) containing about 10% active material (polysiloxane/silica) in water | 0.3 | 0.3 | 0.3 |
| Hydrogenated fatty acid having in average 18 to 22 carbon atoms (HYFAC) | 0.75 | 0.75 | 0.75 |
| Proteolytic enzyme (Maxatase, commercial enzyme preparation containing 15% pure enzyme) | 0.4 | 0.4 | 0.4 |
| Diethylenetriaminepentamethylenephosphonic acid | 0.3 | 0.3 | 0.3 |
| Citric acid | 0.2 | 0.2 | 0.2 |
| Perfume, dyes | 0.8 | 0.8 | 0.8 |
| Water | Balance to 100 | | |

The compositions were used for washing standard test swatches stained with milk-ink, egg-ink, tea and blueberry sirup. The test swatches were washed in a launderometer (LHD-EF Model B-5, Atlas Electronic Devices Co, Chicago, USA) using the following conditions:

| | |
|---|---|
| Product concentration: | 1% |
| Water: | 200ml city water |
| Test swatches: | 2 cotton pieces (1 milk-ink, 1 egg-ink) per jar<br>4 cotton pieces (2 tea, 2 blueberry) per jar |
| Wash temperature: | 60° C. (time to reach 60° C.: about 40'). |

The temperature was maintained for 10 minutes at 60° C. The jars were opened and the test swatches were rinsed under streaming cold water and dried.

The degree of stain removal was measured by light reflectance using an EEL reflectance spectrophotometer connected with a galvanometer (Evans Electroselenium LTD, Halstead, England).

The results express the difference in stain removal between prior art compositions B, D and E and composition VII in accordance with this invention.

The measured differences in reflection units were as follows:

| Product | Egg-ink | Milk-ink |
|---|---|---|
| B | reference | |
| D | +0.3 | −2.7* |
| E | −0.3 | 0 |
| VII | +0.1 | +0.2 |

The swatches with the tea spots and blueberry sirup were graded by a paired comparison technique using product B as reference. The test results were as follows:

| Product | Tea (in psu) | Blueberry (in psu) |
|---|---|---|
| B | reference | |
| D | −1.27* | −0.90 |
| E | −0.95 | −0.35 |
| VII | +0.03 | +0.35 |

*significant difference

The results show that composition VII according to the present invention, is not affected by the shortcomings of closely related compositions D and E.

What is claimed is:

1. A storage stable, homogeneous, non gelling heavy-duty liquid detergent composition of special effectiveness against make-up and dirty motor oil stains on cotton and polyester, consisting by weight of (a) 24% triethanolamine salt of a linear alkylbenzene sulfonic acid wherein the alkyl chain length averages 11.7 carbon atoms in length;

(b) 18.5% condensation product of 7 moles of ethylene oxide with 1 mole of a primary alcohol of about 25% branched chain structure having 14 to 15 carbon atoms in average;

(c) 3.5% coconut ($C_{12}$–$C_{14}$) dihydroxyethylmethyl ammonium chloride;

(d) 0.23% stilbene brightener;

(e) 10% ethanol (f) 1.5% (free) triethanolamine;

(g) 0.3% of a 9:1 mixture of dimethylpolysiloxane and aerogel silica emulsified with the aid of ethoxylated stearic acid so as to contain about 10% active material (polysiloxane/silica) in water;

(h) 0.75% hydrogenated fatty acid having in average 18–22 carbon atoms;

(i) 0.4% proteolytic enzyme composition containing 15% pure enzyme;

(j) 0.3% diethylenetriaminepentamethylenephosphonic acid;

(k) 0.2% citric acid;

(l) 0.8% perfume and dyes;

(m) the balance being water.

* * * * *